US008016105B2

(12) United States Patent
Sendo

(10) Patent No.: US 8,016,105 B2
(45) Date of Patent: Sep. 13, 2011

(54) PACKAGE FOR ROD-LIKE SMOKING ARTICLES

(75) Inventor: Makoto Sendo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 5 days.

(21) Appl. No.: 11/183,829

(22) Filed: Jul. 19, 2005

(65) Prior Publication Data

US 2005/0252796 A1 Nov. 17, 2005

Related U.S. Application Data

(63) Continuation of application No. PCT/JP03/16844, filed on Dec. 26, 2003.

(30) Foreign Application Priority Data

Jan. 20, 2003 (JP) ..... 2003-011361

(51) Int. Cl.
*B65D 85/10* (2006.01)

(52) U.S. Cl. ..... 206/264; 206/268; 206/273

(58) Field of Classification Search ..... 206/268, 206/261, 242, 271, 265, 259, 264, 273, 813, 206/250; 229/87.12–87.14, 160.1
See application file for complete search history.

(56) References Cited

U.S. PATENT DOCUMENTS

| | | | | |
|---|---|---|---|---|
| 3,093,292 | A * | 6/1963 | Ahlbor | 206/264 |
| 4,300,676 | A * | 11/1981 | Focke et al. | 206/264 |
| 5,123,589 | A | 6/1992 | Cote | |
| 5,462,223 | A * | 10/1995 | Focke et al. | 229/160.1 |
| 6,199,687 | B1 * | 3/2001 | Tambo et al. | 206/268 |
| 6,244,435 | B1 * | 6/2001 | Cho | 206/264 |

FOREIGN PATENT DOCUMENTS

| | | | |
|---|---|---|---|
| BE | 365 658 | A | 12/1929 |
| DE | 25 51 427 | A1 | 5/1977 |
| DE | 40 32 870 | A1 | 4/1992 |
| EP | 0 895 940 | A2 | 2/1999 |
| GB | 108139 | A | 7/1917 |
| JP | 53-27896 | A | 3/1978 |
| JP | 55-26054 | B2 | 7/1980 |
| JP | 2000-509681 | A | 8/2000 |
| JP | 2001-504069 | A | 3/2001 |
| JP | 2003-341616 | A | 12/2003 |
| WO | WO-98/22367 | A1 | 5/1998 |

* cited by examiner

*Primary Examiner* — Steven A. Reynolds
(74) *Attorney, Agent, or Firm* — Birch, Stewart, Kolasch & Birch, LLP

(57) ABSTRACT

A package for rod-like smoking articles includes a box having an inner frame, a lid for opening/closing the opening end of the box, and the contents contained in the box. The contents include wrapper that wraps a bundle of filter cigarettes therein. The wrapper has a separable area demarcated by a separating line. The separable area is bonded to the inner face of the lid at a glue-applied area. When the lid is first opened, the separable area is separated from the wrapper by the swing movement of the lid to form a separated piece. The separated piece is kept in the state bonded to the inside of the lid.

10 Claims, 8 Drawing Sheets

PACKAGE FOR ROD-LIKE SMOKING ARTICLES

This application is a Continuation of co-pending PCT International Application No. PCT/JP2003/016844 filed on Dec. 26, 2003, which designated the United States, and on which priority is claimed under 35 U.S.C. §120. This application also claims priority under 35 U.S.C. §119(a) on Patent Application No(s). 2003-11361 filed in Japan on Jan. 20, 2003. The entire contents of each of the above documents is hereby incorporated by reference.

TECHNICAL FIELD

The present invention relates to a package for rod-like smoking articles, such as cigarettes and filter cigarettes.

BACKGROUND ART

A package of this type is disclosed in for example Examined Japanese Patent Publication No. 55-26054. This well-known package includes a box having an opening end, an openable/closable lid hingedly jointed to the rear edge of the opening end, and contents contained in the box. The contents have a bundle of rod-like smoking articles wrapped in wrapper. The wrapper has a separating line, which defines part of the wrapper as a separable area.

When a consumer, namely smoker first opens the lid of the package, then the smoker separates the separable area of the wrapper therefrom. As a result, part of the bundle of rod-like smoking articles in the contents is exposed outside through the front wall of the box. More specifically, the front wall of the box includes an inner frame, and part of the bundle of rod-like smoking articles is exposed outside through an U-shaped access opening formed in the inner frame. Therefore, the smoker can easily pull a rod-like smoking article out of the box through the access opening of the inner frame.

According to the above-mentioned package, whenever the smoker intends to firstly open the lid of the package and contact the rod-like smoking articles, he or she has to remove the separable area of the contents from the wrapper. Therefore, it is inconvenient for the smoker to pull a rod-like smoking article out of the package for the first time.

When removed from the wrapper, the separable area forms a separated piece that will be trash and the disposal of the separated piece is also bothersome for the smoker.

An object of the invention is to provide a package for rod-like smoking articles, in which when the package is first opened, a rod-like smoking article can be easily pulled out of the package, and a separated piece that would be trash after the opening of the package is not produced.

DISCLOSURE OF THE INVENTION

To achieve the above-mentioned object, a package of the invention has a box including a front wall, an opening end, and one of an access opening formed in the front wall to extend from a front edge of the opening end and a cutting line for forming an access opening, the cutting line demarcating an intended area to be opened in the front wall, contents contained in the box, the contents including a bundle of rod-like smoking articles, wrapper for wrapping the bundle therein and forming a closed face of the contents on the opening end side, and a separable area demarcated in the wrapper by a separating line, the separable area having a front portion corresponding to the access opening or the intended area to be opened, a lid hingedly jointed to a rear edge of the opening end of the box, the lid including an inner face for covering the access opening or the intended area to be opened and the opening end, and a connecting area for connecting the inner face of the lid and the separable area to each other through the access opening or the intended area to be opened.

According to the above-described package, when the package is fabricated, the inner face of the lid and the separable area of the wrapper are directly or indirectly bonded together through the access opening or the intended area to be opened. When the lid is first opened in such a state so that the lid is swung, the separable area is separated from other part of the wrapper or is separated from the other part of the wrapper along with cutting of the intended area to be opened from the box, thus forming a separated piece. The separated piece is kept in a state bonded directly or through a separated piece produced by the cutting of the intended area to be opened, to the inner face of the lid.

Consequently, it is unnecessary, when the package is first opened, to discard the separated piece produced by the separation of the separable area and/or the separated piece produced by the cutting of the intended area to be opened.

More specifically, the package is a hinge-lid pack provided with an inner frame. The box of the package may include the access opening in advance.

In this case, the connecting area includes a first bonding area for bonding the inner face of the lid and the front portion of the separable area to each other through the access opening.

In a case that the closed face of the contents includes a pair of end flaps, an inner side flaps and an outer side flap as part of the separable area, these side flaps sequentially overlapping the end flaps, the connecting area may further include a second bonding area for bonding the outer side flap to the inner face of the lid.

When the connecting area includes both the first and second bonding areas as stated, the separable area is separated without fail.

The separating line preferably has slits for separating the outer side flap from the other part of the wrapper. These slits further facilitate the separation of the separable area.

Furthermore, the package of the invention is a pack provided with a tongue lid. In this case, the box has a slit in the front wall thereof, the slit being located closer to a bottom side of the box than the access opening or the intended area to be opened. The tongue lid includes a ceiling wall for covering the opening end of the box, a tongue for covering the access opening or intended area to be opened of the box, the tongue having a tip end insertable into the slit, and reinforcing members glued to the inner face of the ceiling wall. The reinforcing members are cut off from the box when the tongue lid is first opened.

In the case of the above-described tongue-lid pack, the connecting area includes a first bonding area for bonding an inner face of the tongue to the front portion of the separable area directly through the access opening or with the intended area to be opened intervening therebetween.

When the closed face of the contents includes a pair of end flaps, an inner side flap and an outer side flap as part of the separable area, these side flaps sequentially overlapping the end flaps, the connecting area may further include a second bonding area for bonding the outer side flap and the reinforcing members to each other.

BEST MODE OF CARRYING OUT THE INVENTION

Figure 1:
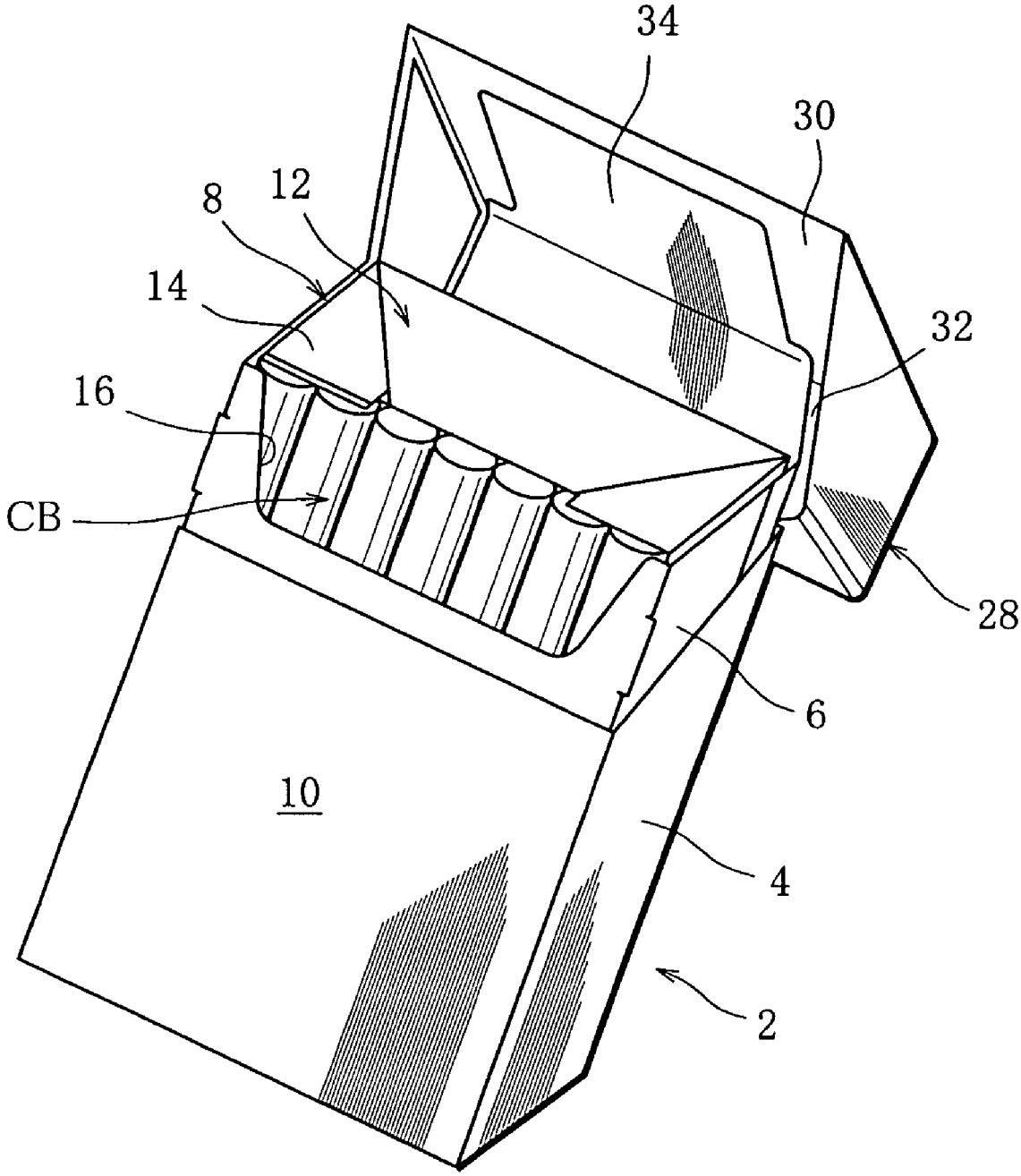
FIG. 1 is a perspective view of a hinge-lid pack in a state where a lid thereof is opened.

FIG. 1 shows a hinge-lid pack for filter cigarettes. The pack is formed in a shape of a rectangular parallelepiped and is wrapped in a film (not shown), having a tear tape.

The pack includes a box 2, which has an outer casing 4 and an inner frame 6. The outer casing 4 has an open upper end. The opening face of the upper end is slanted down toward a front wall 10 of the box 2. The inner frame 6 has a shape of the letter U in section and is disposed in the outer casing 4. The inner frame 6 protrudes from the upper end of the outer casing 4 and forms an opening end 8 of the box 2 in cooperation with the outer casing 4.

The box 2 contains contents 12, which have a cigarette bundle CB and wrapper 14 for wrapping the cigarette bundle CB therein. For example, the cigarette bundle CB includes twenty filter cigarettes.

The wrapper 14 has a base layer made of paper or the like, and a thin layer of metal formed on a surface of the base layer. The wrapper 14 is sorted as a burnable waste material as a blank for producing the box 2 is, whereas the film is sorted as an unburnable waste material.

The contents 12 have an upper closed face, which is formed by folding the wrapper 14. The upper closed face of the contents 12 is exposed from the opening end 8 of the box 2. An upper portion of a front face of the contents 12 is also exposed from the inner frame 6. More specifically, the inner frame 6 has a substantially U-shaped access opening 16 in an upper edge thereof. The access opening 16 causes the upper portion of the front face of the contents 12 to be exposed.

Figure 2:
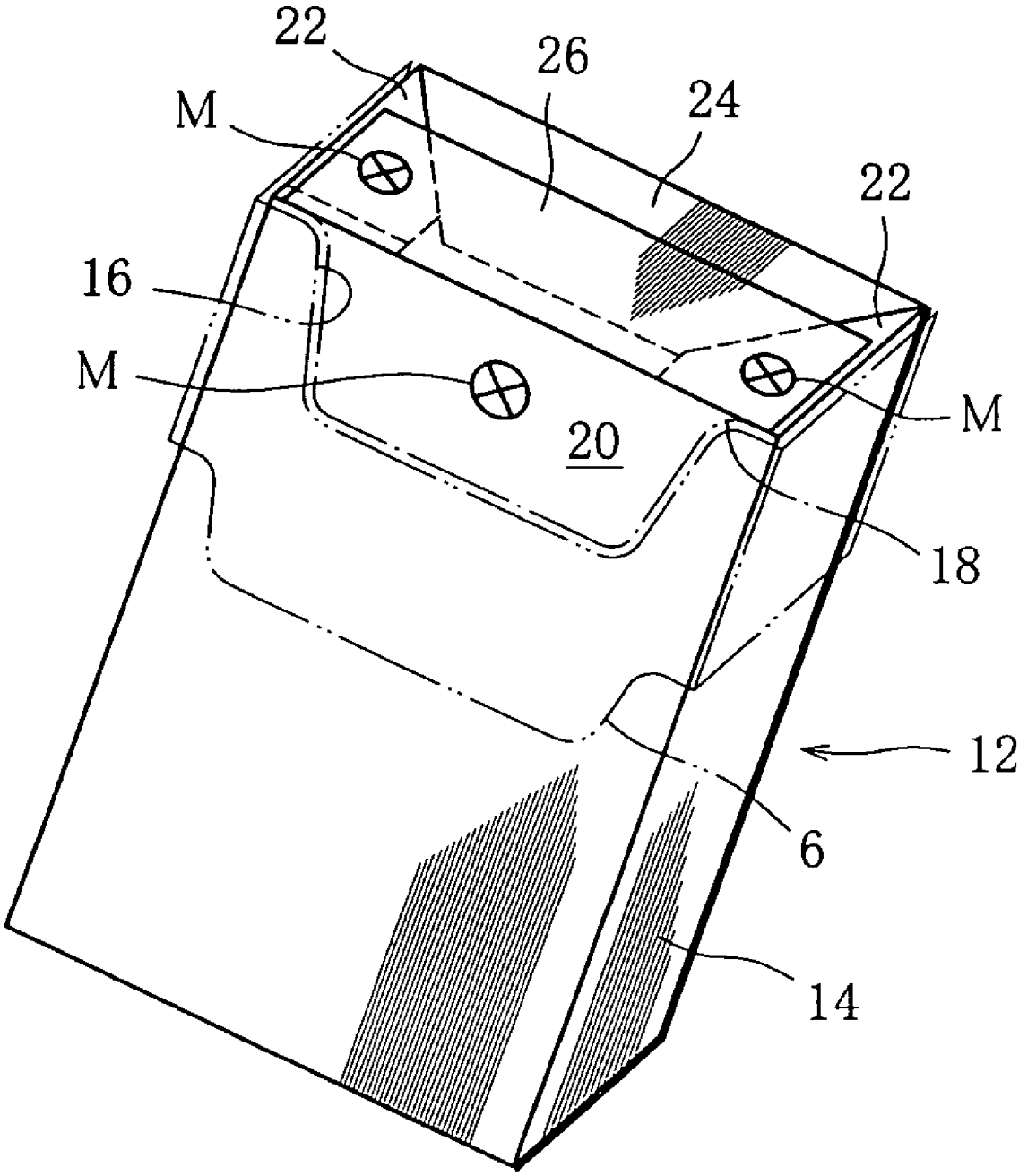
FIG. 2 is a perspective view of contents contained in the pack.

The wrapper 14 of the contents 12 has a separating line 18 shown as a dashed line in FIG. 2. The separating line 18 demarcates part of the wrapper 14 as a separable area 20. The separable area 20 includes a portion corresponding to the access opening 16 of the inner frame 6 and part of the upper closed face of the contents 12.

More specifically, as is evident from FIG. 2, the upper closed face of the contents 12 has right and left end flaps 22 of the wrapper 14, and an inner flap 24 and an outer flap 26 that sequentially overlap the end flaps 22, and the separable area 20 includes the outer flap 26.

Figure 3:
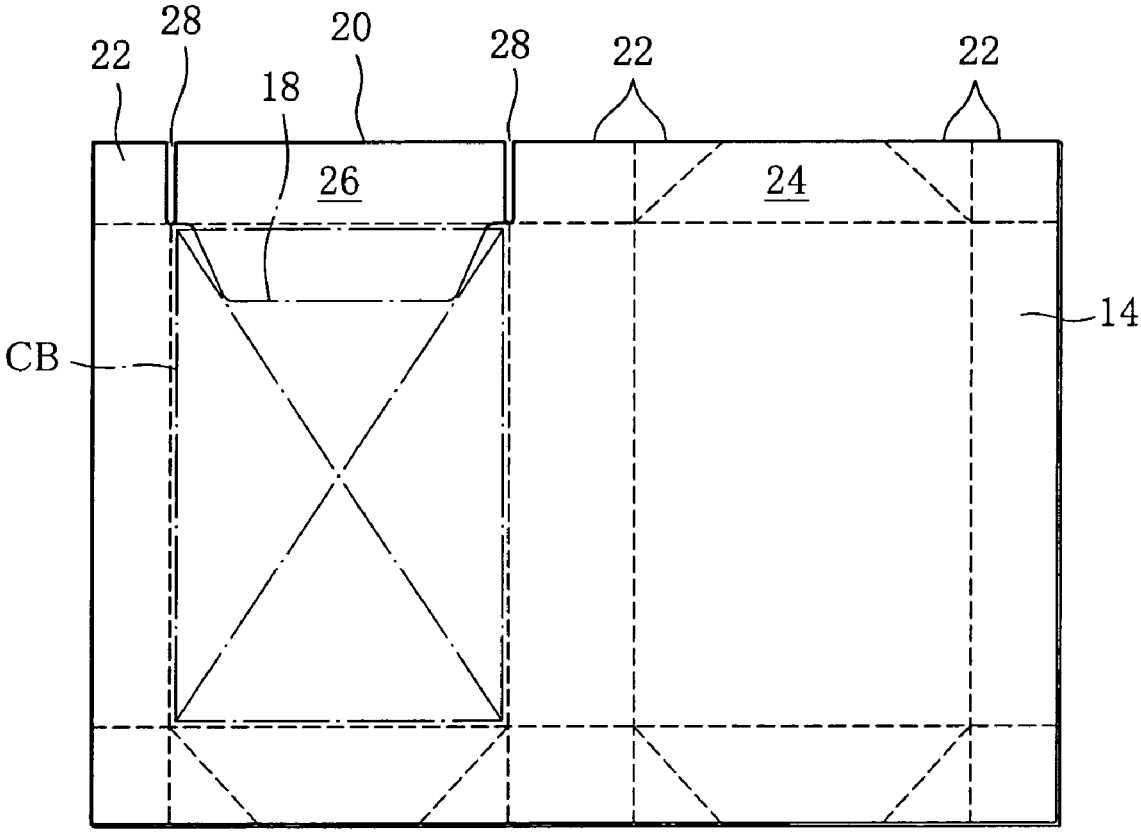
FIG. 3 is a development view of wrapper of the contents.

FIG. 3 is a development view of the wrapper 14. As is clear from the development view, the separating line 18 demarcating the separable area 20 has two slits 28 and a row of perforations for connecting between the two slits 28. The slits 28 are located between a portion of the wrapper 14 for forming the outer flap 26 and the other portions of the wrapper 14, that is, portions of the wrapper 14 for forming the end flaps 22. The slits 28 thus separate the outer flap 26 from the end flaps 22.

The row of perforations of the separating line 18 demarcates a portion corresponding to the access opening 16 of the inner frame 6. The slits 28 are replaceable with rows of perforations.

Broken lines in FIG. 3 indicate folding lines of the wrapper 14. The wrapper 14 is folded around the cigarette bundle CB along the folding lines, thus producing the aforementioned contents 12. In FIG. 3, a lower portion of the wrapper 14 forms a lower closed face of the contents 12, that is, a bottom thereof.

Referring to FIG. 1 again, the pack further includes a lid 28, which is integrally jointed to a rear edge of the opening end 8 of the box 2 (outer casing 4) with a self hinge. The lid 28 is therefore rotatable around an axis of the self hinge, thereby opening/closing the opening end 8 of the box 2 by the swing movement.

When closed, the lid 28 covers part of the inner frame 6, which protrudes from the outer casing 4, and the opening edge of the lid 28 meets an opening edge of the outer casing 4. That is to say, an opening face of the lid 28 also slants along the inclination of the opening face of the outer casing 4.

More specifically, the lid 28 has a front inner face 30 that overlaps the front face having the access opening 16 of the inner frame 6, a ceiling face 32 superposed upon the upper closed face of the contents 12, and inner side faces that overlap respective side faces of the inner frame 6.

As illustrated in FIG. 1, when the lid 28 is opened, the separable area 20 is simultaneously separated from the wrapper 14 to produce a separated piece 34. The separated piece 34 is kept in a state bonded to the front inner face 30 and the ceiling face 32 of the lid 28. As a result, the cigarette bundle CB of the contents 12 is partially exposed through the access opening 16 of the inner frame 6, making it possible to pull a filter cigarette of the cigarette bundle CB out of the access opening 16.

Figure 4:
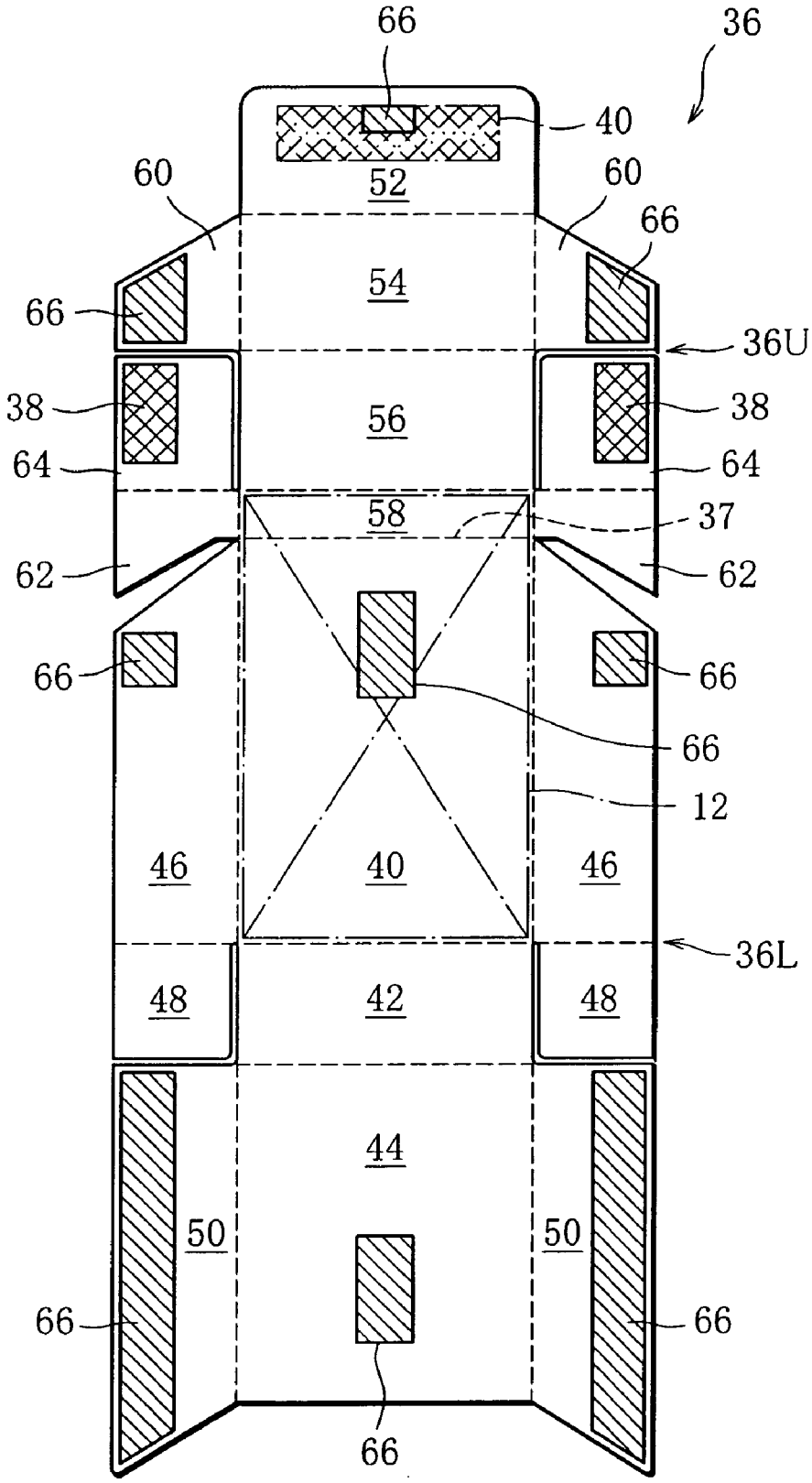
FIG. 4 is a development view of a blank for forming an outer casing and the lid of FIG. 1.

In order to produce the separated piece 34, the separable area 20 of the wrapper 14 is beforehand in a state bonded to the front inner face 30 and the ceiling face 32 of the lid 28 in a fabricating process of the pack. Such a bonded state is provided by adding glue-applied areas 38 and 40 shown in FIG. 4 to a blank 36 for producing the outer casing 4 and the lid 28. FIG. 4 shows a reverse face of the blank 36. The glue-applied areas 38 and 40 are cross-hatched in FIG. 4.

In FIG. 4, the blank 36 includes a lower section 36L for forming the outer casing 4 and an upper section 36U for forming the lid 28. The lower section 36L and the upper section 36U are connected to each other through a folding line 37 forming the self hinge. In the following explanation, other folding lines are shown by broken lines in FIG. 4 in the same manner as the folding line 37.

The lower section 36L has a rear panel 40 in an upper portion thereof. The rear panel 40 is a portion for forming a rear wall of the outer casing 4. In FIG. 4, a front panel 44 is connected to a lower side of the rear panel 40 with an outer bottom panel 42 intervening therebetween. The outer bottom panel 42 and the front panel 44 are portions for forming a front wall 10 and bottom wall of the outer casing 4, respectively. Folding lines demarcate the rear panel 40 from the outer bottom panel 42, and the outer bottom panel 42 from the front panel 44, respectively.

A pair of inner side flaps 46 is connected to respective side edges of the rear panel 40 through folding lines. The inner side flaps 46 are portions for forming inner side walls of the outer casing 4. An inner bottom flap 48 is connected to a lower edge of each of the inner side flaps 46 through a folding line. The inner bottom flaps 48 are located on respective sides of the outer bottom panel 42. The inner bottom flaps 48 serve as reinforcements for the bottom wall of the outer casing 4.

A pair of outer side flaps 50 is connected to respective side edges of the front panel 44 through folding lines. The outer side flaps 50 are portions for forming outer side walls of the outer casing 4. In other words, each side wall of the outer casing 4 is formed of the inner and outer side flaps 46 and 50.

The upper section 36U has a rectangular portion connected to the rear panel 40 through the folding line 37. The rectangular portion is demarcated into four panels by folding lines. These panels are called an inner front panel 52, an outer front panel 54, an outer top panel 56, and a rear panel 58 in order from the top in FIG. 4.

The outer front panel 54 is a portion for forming a front wall of the lid 28. Side outer flaps 60 are connected to respective side edges of the outer front panel 54 through folding lines.

Likewise, inner side flaps 62 are connected to respective sides of the rear panel 58 through folding lines. The inner side flaps 62 and the outer side flaps 60 are portions for forming side walls of the lid 28 together.

Furthermore, top inner flaps 64 are connected to the respective inner side flaps 62 through folding lines. The top inner flaps 64 are located on respective sides of the outer top panel 56 and serve as reinforcements for the ceiling wall of the lid 28.

The aforementioned panels and flaps are applied with glue in prescribed locations on their reverse faces, namely areas 66 that are hatched in FIG. 4. The glue-applied areas 66 are used to bond the contents 12 to the blank 36 and to bond the overlapped flaps to each other.

Although the glue-applied areas 66 are provided to a conventional pack, the pack of the invention is newly provided with the glue-applied areas 38 and 40.

As is apparent from FIG. 4, the glue-applied areas 38 are formed in part of the respective top inner flaps 64. The glue-applied areas 38 are located correspondingly to respective end portions of the outer flap 26 that forms the upper closed face of the contents 12 (see FIG. 2).

The glue-applied area 40 is formed in the front face of the inner front panel 52 and is located correspondingly to the access opening 16 of the inner flap 6.

The fabricating process of the pack will be explained below with reference to FIGS. 5 through 7.

Figure 5:
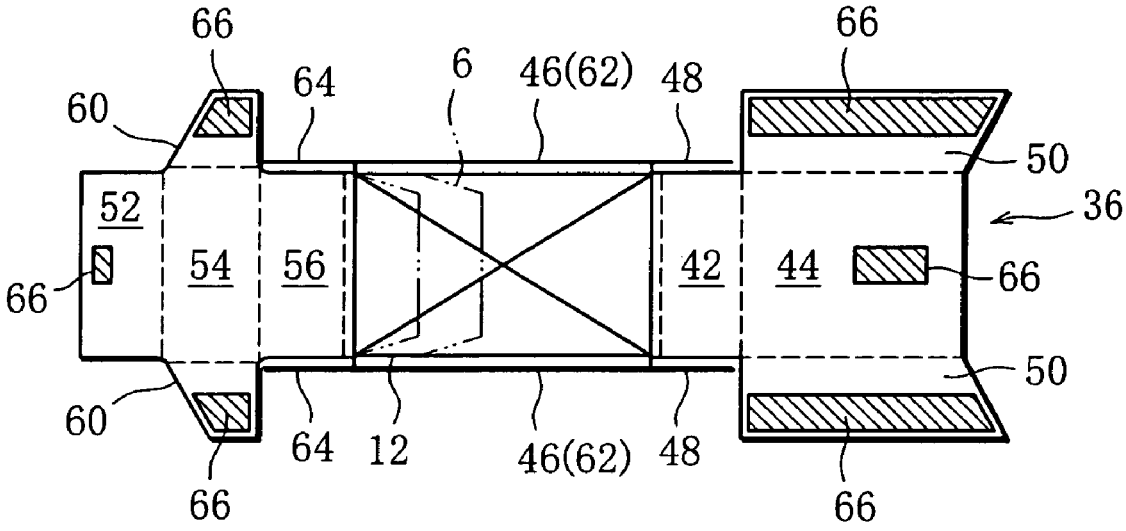
FIGS. 5 through 7 are views for explaining a folding procedure of the blank of FIG. 4 in order.

As illustrated in FIG. 5, the contents 12 are supplied onto the reverse face of the blank 36. The contents 12 are superposed upon the rear panel 40, and the contents 12 and the rear panel 40 are bonded to each other at the glue-applied area 66.

Before the contents 12 are supplied onto the rear panel 40, the contents 12 are provided with the inner frame 6 in an upper face thereof, and the inner frame 6 and the contents 12 are bonded to each other.

Subsequently, the inner side flaps 46 are folded toward the respective side faces of the contents 12, and are superposed on the side faces thereof. At this time, the glue-applied areas 66 of the respective inner side flaps 46 bond the inner side flaps 46 to the side faces of the contents 12.

Simultaneously with the folding of the inner side flaps 46, the inner side flaps 62 are folded together with the top inner flaps 64 in the same manner. Therefore, the inner side flaps 62 are aligned with the respective top inner flaps 64 together with the respective inner side flaps 46.

Figure 6:
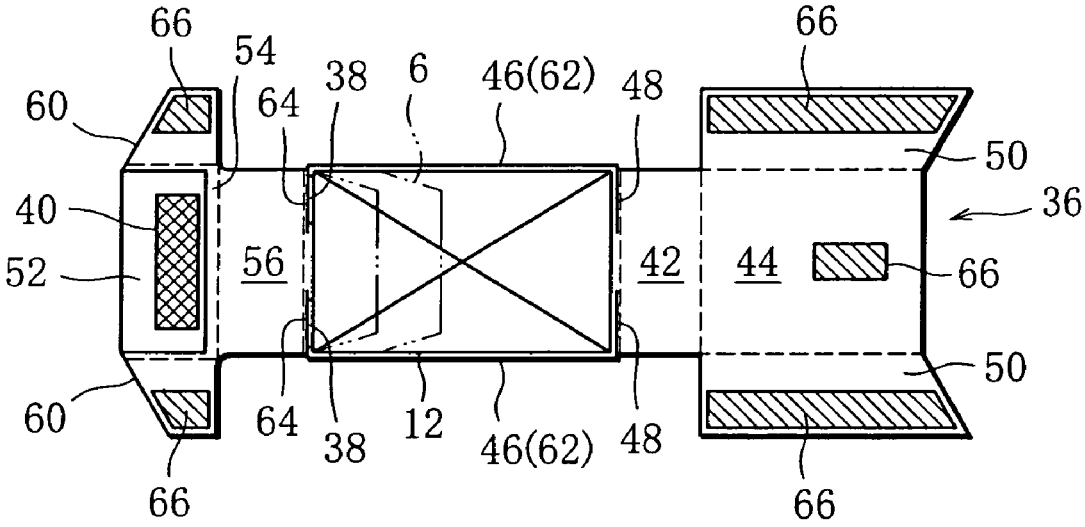

In the next stage, as illustrated in FIG. 6, the inner bottom flaps 48 are folded toward the bottom of the contents 12, and are superposed on the bottom thereof. At the same time, the inner top flaps 64 are also folded toward the upper closed face of the contents 12, and are superposed on the upper closed face thereof. At this time, the glue-applied areas 38 bond the inner top flaps 64 to the outer flap 26 of the upper closed face.

As illustrated in FIG. 6, the inner front panel 52 is folded toward the outer front panel 54, and is superposed on the outer front panel 54.

The glue-applied area 66 of the inner front panel 52 bonds the inner and outer front panels 52 and 54 to each other. The inner and outer front panels 52 and 54 bonded together form the front wall of the lid 28.

It should be noted that the glue-applied area 40 appears on the reverse face side of the blank 36 after the folding of the inner front panel 52.

Thereafter, the outer bottom panel 42 is folded toward the bottom of the contents 12 together with the front panel 44, and is superposed upon the bottom thereof. The front panel 44 is folded toward the upper surface of the contents 12, and is superposed on the upper surface so that the inner frame 6 is sandwiched between the contents 12 and the front panel 44. The glue-applied area 66 of the front panel 44 bonds the front panel 44 and a lower portion of the inner frame 6 to each other.

At the same time of the folding of the front panel 44, the outer top flap 56 is folded toward the upper closed face of the contents 12, and is superposed on the upper closed face thereof so that the inner top flaps 64 are sandwiched between the contents 12 and the outer top flap 56. At this stage, the front wall (inner and outer front panels 52 and 54) of the lid 28 is in an upright position in relation to the upper surface of the contents 12 with the right and left outer side flaps 60.

Subsequently, the front wall of the lid 28 is folded toward the upper surface of the contents 12 together with the outer side flaps 60, and is superposed on the upper surface thereof.

In this process, the front wall of the lid 28, that is, the glue-applied area 40 of the inner front panel 52, is brought into contact with the separable area 20 of the wrapper 14 in the contents 12 through the access opening 16 of the inner frame 6, thereby bonding the separable area 20 and the front wall of the lid 28 to each other. This state is shown in FIG. 7.

Figure 7:
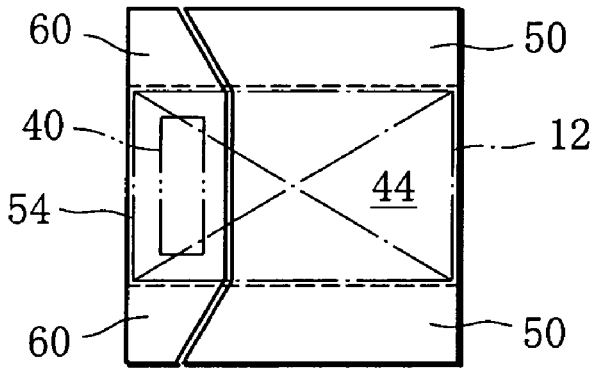

At this state, as is obvious from FIG. 7, the outer side flaps 60 on the lid 28 side and the outer side flaps 50 on the box 2 side are in a position protruding from the respective side faces of the contents 12.

Thereafter, the outer side flaps 60 and 50 are folded toward the respective side faces of the contents 12, and are superposed on the side faces, or the inner side flaps 62 and 46 that have already been folded. The glue-applied areas 66 of the outer side flaps 60 and 50 bond the outer side flaps 60 and 50 to the inner side flaps 62 and 44, respectively. At this time, the fabrication of the pack is completed.

A folding procedure of the blank 36 is similar to that of a conventional blank. Therefore, the pack of the invention can be easily fabricated simply by installing a glue applicator (not shown) for forming the glue-applied areas 38 and 40 in a conventional packing machine.

Thereafter, the pack is supplied to a film-wrapping machine (not shown). The film-wrapping machine wraps the pack in a film having a tear tape.

In a condition that the lid 28 of the pack is still unopened, the separable area 20 of the wrapper 14 is bonded to the ceiling face 32 and the inner face 30 of the front wall of the lid 28. Specifically, the outer flap 26 of the wrapper 14, which is a part of the separable area 20, is bonded to the ceiling face 32 (a pair of inner top flaps 64) of the lid 28 at the glue-applied areas 38. The other part of the separable area 20 is bonded to the inner face 30 (inner front panel 52) of the front wall of the lid 28 at the glue-applied area 40.

In FIG. 2, the bonding locations of the separable area 20, at which the separable area 20 is bonded by the glue-applied areas 38 and 40, are shown by the letter M.

When the lid 28 of the pack is first rotated around the self hinge thereafter, that is, when the lid 28 is first opened, since the separable area 20 is bonded to the lid 28, the swing movement of the lid 28 separates the separable area 20 from the wrapper 14. The separation of the separable area 20 produces the separated piece 34 as shown in FIG. 1. The separated piece 34 is kept in a state bonded to the inner face of the lid 28.

The smoker can separate the separable area 20 of the wrapper 14 simply by opening the lid 28 first, so that the smoker does not have to remove the separable area 20 by hand after opening the lid 28. This saves the smoker the trouble of separating the separable area 20 and also facilitates the opening of the pack.

Since the separated piece 34 is bonded to the inner face of the lid 28, the separated piece 34 does not come off the lid 28. This eliminates the need for disposal of the separated piece 34 at the time the opening of the pack. After the filter cigarettes within the pack are all consumed, the separated piece 34 is discarded with the empty pack.

Since the separable area 20 is bonded to the inner face of the lid 28 at three locations, when the lid 28 is rotated, the separable area 20 is surely separated along the separating line 18 (see FIG. 2), and part of the separated piece 34 does not protrude outside the lid 28.

The outer flap 26 of the separable area 20 is completely apart from the other part of the wrapper 14 by the slits 28 (see FIG. 2). Therefore, when the separable area 20 is separated, the outer flap 26 is not caught on the inner frame 6 or the outer casing 4 to seriously obstruct the separation of the separable area 20.

The invention is not limited to the above-described one embodiment, but various modifications can be made.

For example, the separating line 18 demarcating the separable area 20 may be wholly formed of a slit line.

The separable area may be an area to be cut off which is included in the contents for a conventional pack. In this case, the wrapper 14 forms the upper closed face of the contents 12 in a conventional folded pattern.

Figure 8:
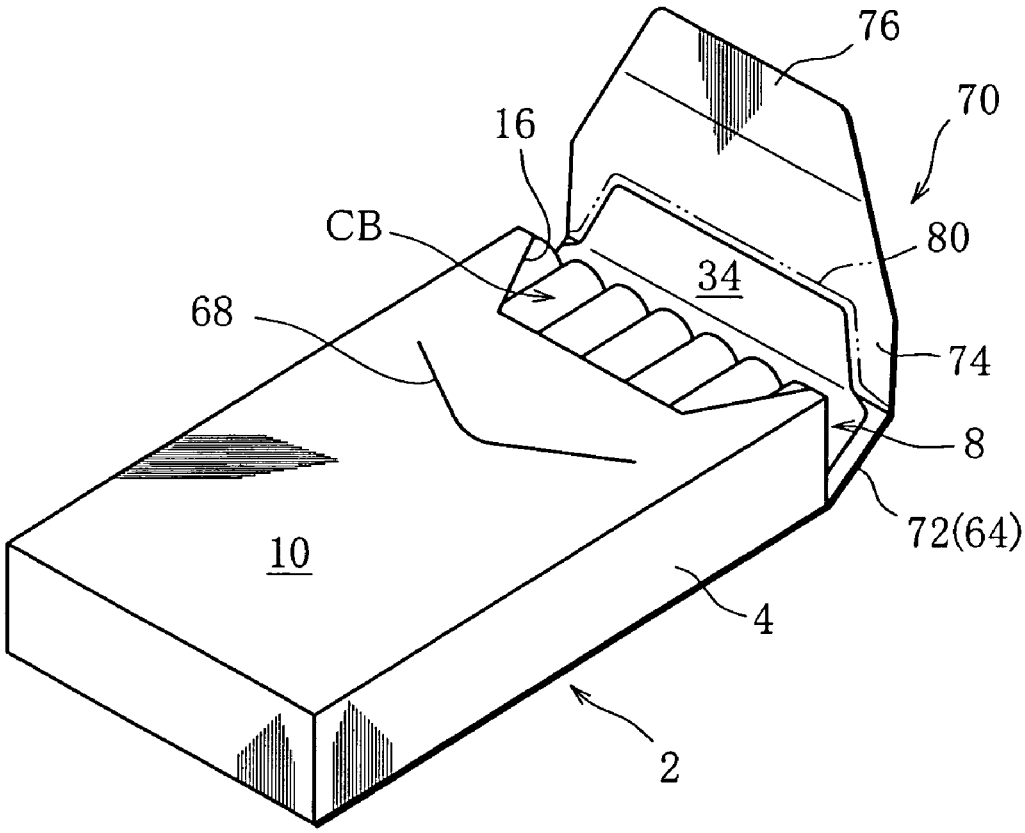
FIG. 8 is a perspective view of a tongue-lid pack.

Although the package shown in FIG. 1 is a hinge-lid pack, the package of the invention is applicable to packs having lids of various patterns like a tongue-lid pack shown in FIG. 8.

According to the tongue-lid pack of FIG. 8, a body 2 is formed of an outer casing 4 only and does not have an inner frame 6. Therefore, the outer casing 4 has an access opening 16 formed in a front wall thereof.

Formed in the front wall 10 of the outer casing 4 is an insertion slit 68. The insertion slit 68 is located under the access opening 16 and is formed to have a shape of the letter V that splays toward the access opening 16.

The outer casing 4 is provided with a tongue lid 70 instead of the box-shaped lid 28. The tongue lid 70 is connected to a rear edge of an opening end 8 in the outer casing 4 through a self hinge.

The tongue lid 70 has a ceiling wall 72 that closes an upper closed face of contents 12 and a tongue 74 connected to the ceiling wall 72 through a folding line. When the tongue 74 is superposed on the front wall of the outer casing 4, the tongue 74 can cover both the access opening 16 and the insertion slit 68. A tip end portion of the tongue 74 is formed as a tapered inserting piece 76, which is demarcated by a folding line from a base of the tongue 74. The inserting piece 76 is insertable into the outer casing 4 through the insertion slit 68 of the outer casing 4.

Figure 9:
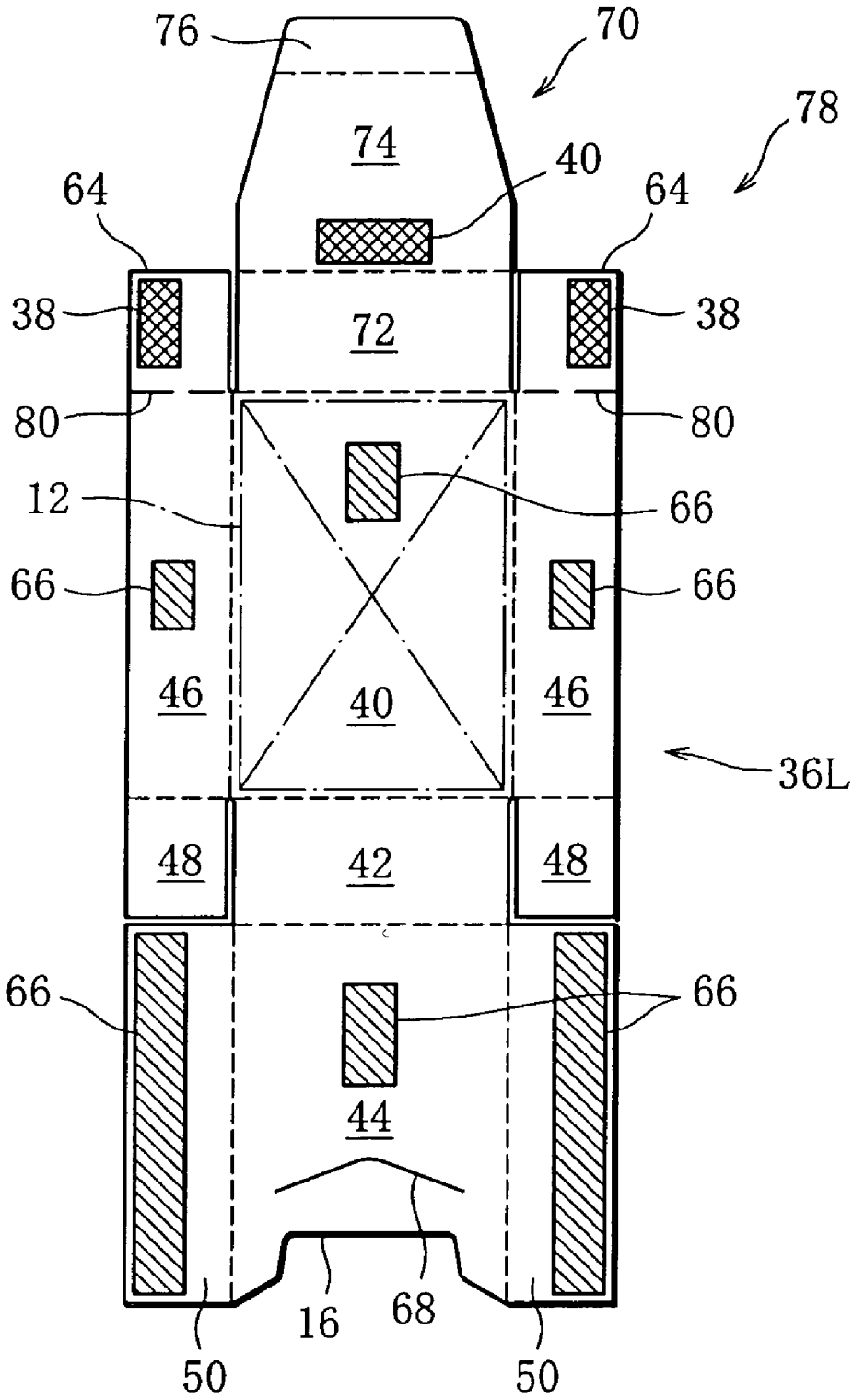
FIG. 9 is a development view of a blank for the pack of FIG. 8.

The pack of FIG. 8 is produced with a blank 78 shown in FIG. 9. The blank 78 differs from the blank 36 in the following points.

A front panel 44 of the blank 78 has the access opening 16 and the insertion slit 68. A tongue lid 70 is connected to a rear panel 40 through a folding line forming a self hinge.

Glue-applied areas 38 are formed in front faces and reverse faces of inner top flaps 64. The inner top flaps 64 are connected to the respective inner side flaps 46 through cutting lines 80 instead of folding lines.

A glue-applied area 40 is formed in a reverse face of a tongue 74 and is located in a position corresponding to the access opening 16.

Although a folding procedure of the blank 78 is substantially the same as that of the blank 36, the tongue lid 70 is folded toward the front panel 44 after the folding of the front panel 44 is completed. In other words, the tongue 74 of the tongue lid 70 is superposed on the front panel 44.

When the tongue-lid pack is fabricated, the outer flap 26 (see FIG. 2) of the separable area 20 is bonded to the inner top flaps 64 at the glue-applied areas 38 formed in the reverse faces thereof, whereas the inner top flaps 64 are bonded to an inner face of a ceiling wall 72 of the tongue lid 70 at the glue-applied areas 38 formed in the front faces thereof. The glue-applied area 40 is located within the access opening 16 and bonds the tongue 74 of the tongue lid 70 and the separable area 20 to each other.

When the tongue lid 70 of the tongue-lid pack is first opened, the inner top flaps 64 are cut off from the respective inner side flaps 46, and at the same time, the separable area 20 is separated from the wrapper 14 to form a separated piece 34. The separated piece 34 is kept in a state bonded to the tongue lid 70.

Figure 10:
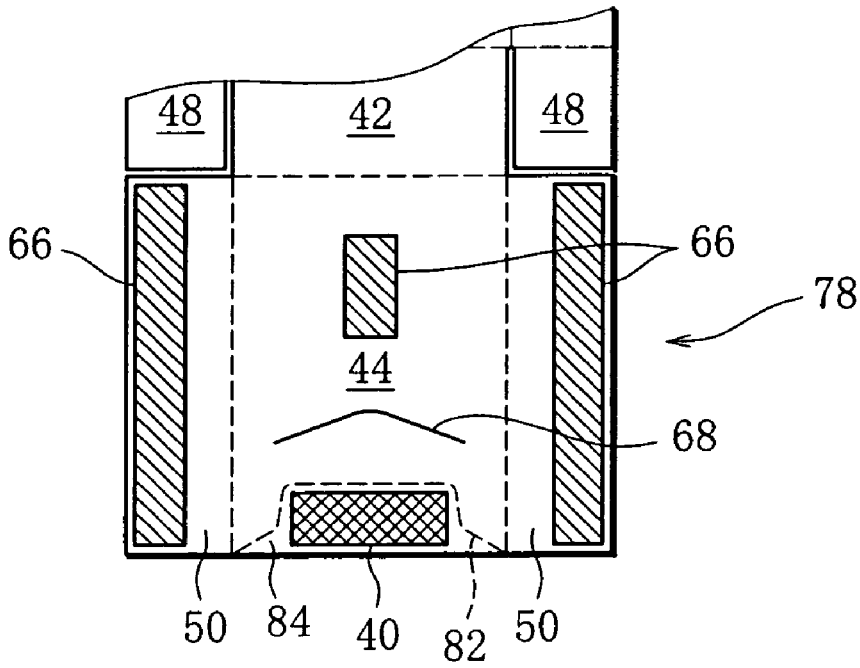
FIG. 10 is a view showing part of a blank of a modification example.

As illustrated in FIG. 10, the blank 78 may have a cutting line 82 instead of the access opening 16. The cutting line 82 is beforehand formed in the front panel 44 of the blank, thus demarcating an intended area 84 to be opened for the access opening 16 in the front panel 44. The intended area 84 to be opened has glue-applied areas 40 in front and reverse faces thereof.

After the pack is fabricated, the separable area 20 is bonded to the reverse face of the intended area 84 to be opened at the glue-applied area 40. The intended area 84 to be opened is bonded to the tongue 74 of the tongue lid 70 at the glue-applied area 40 formed in the front face thereof.

When the tongue lid 70 is first opened, the separable area 20 is separated from the wrapper 14, and simultaneously the intended area 84 to be opened is cut off from the front panel 44. The cutting of the intended area 84 to be opened forms the access opening 16 in the front panel 44.

Separated pieces 34 and 86 (see FIG. 10) formed by the separation of the detachable area 20 and the cutting of the intended area 84 to be opened are each kept in a state bonded to the reverse face of the tongue lid 70.

Figure 11:
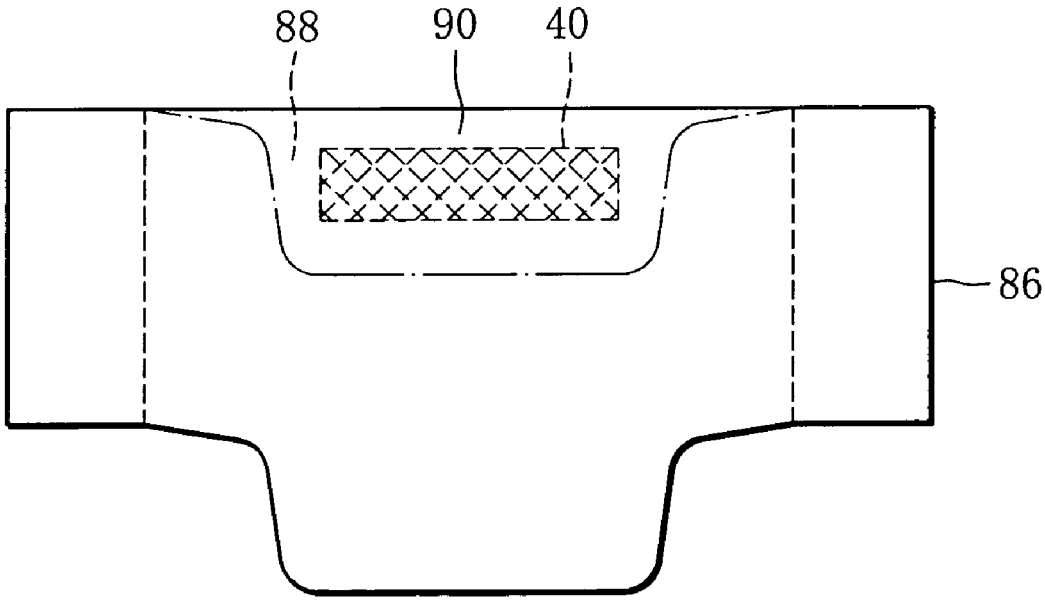
FIG. 11 is a development view of a blank for an inner frame.

The inner frame 6 may have an intended area to be opened, which is similar to the intended area 84 to be opened, instead of the access opening 16. In other words, FIG. 11 shows a blank 86 for producing the inner frame 6. In the blank 86, a cutting line 88 demarcates an intended area 90 to be opened. In this case, the intended area 90 to be opened has a glue-applied area 40 in a reverse face thereof. The glue-applied area 40 bonds the inner frame 6 and the separable area 20 to each other.

The invention claimed is:

1. A package for rod-shaped smoking articles, comprising: a box including a front wall, an opening end, and either an access opening formed in the front wall to extend from a front edge of the opening end or a cutting line for forming the access opening, the cutting line demarcating an intended area to be opened in the front wall;

contents contained in said box, said contents including a bundle of the rod-shaped smoking articles;

a wrapper for wrapping the bundle therein and forming a closed face of said contents on the opening end, the closed face comprising:

a pair of end flaps and inner and outer side flaps sequentially superposed on and above the end flaps, and a separable area demarcated in the wrapper by a separating line, the separable area consisting essentially of the outer side flap and a front portion corresponding to the access opening or the intended area to be opened, the outer side flap having a rear side end facing a rear wall of the box;

a lid jointed to a rear edge of the opening end of said box through a living hinge, for opening and closing the opening end by rotating around the living hinge, said lid including an inner face for covering the access opening or the intended area to be opened and the opening end; and a connecting area for connecting the inner face of said lid and the separable area to each other through the access opening or the intended area to be opened, said connecting area including first bonding areas for bonding the outer side flap to the inner face of said lid, the first bonding areas bonding two lateral side ends of the outer side flap to a ceiling face of said lid, respectively, said connecting area further including a second bonding area for bonding an inner face of a front wall of said lid to the front portion of the separable area through said access opening, or bonding said intended area to be opened on the inner face of the front wall of said lid and the front portion of the separable area, respectively, wherein the separating line consists essentially of a row of perforations for demarcating the front portion of the wrapper and two slits extending from ends of the row of the perforations to the rear side end of the outer side flap to separate the outer side flap from the end flaps, the separable area being separated from the wrapper along the row of perforations when the lid is first opened, and wherein the two slits entirely separate the two lateral side ends of the outer side flap from the respective end flaps, and cooperate with the first bonding areas to cause the outer side flap to be united with the ceiling face of the lid to facilitate the separation of the separable area.

2. The package according to claim 1, wherein:

said package is a hinge-lid pack provided with an inner frame.

3. The package according to claim 2, wherein:

said box includes the access opening in advance.

4. The package according to claim 3, wherein:

said second bonding area bonds the inner face of the front wall of said lid to the front portion of the separable area through the access opening.

5. The package according to claim 1, wherein:

said package is a pack provided with a tongue lid as said lid;

said box has a slit opening in the front wall thereof, the slit opening being located closer to a bottom side of said box than the access opening or the intended area to be opened; and said tongue lid includes a ceiling wall for covering the opening end of said box, a tongue for covering the access opening or intended area to be opened of said box, the tongue having a tip end insertable into the slit opening, and reinforcing members glued to the inner face of the ceiling wall by means of the first bonding areas, the reinforcing members being cut off from said box when the tongue lid is first opened.

6. The package according to claim 5, wherein:

said box includes the access opening in advance.

7. The package according to claim 6, wherein:

said second bonding area bonds an inner face of the tongue to the front portion of the separable area through the access opening.

8. The package according to claim 5, wherein:

said box includes the intended area to be opened.

9. The package according to claim 8, wherein:

said second bonding area bonds the intended area to be opened to an inner face of the tongue and the front portion of the separable area, respectively.

10. The package according to claim 1, wherein the outer side flap has two lateral side ends, and each of the two slits has a first end and a second end, and wherein the two slits respectively start at the first ends from the two ends of the row of the perforations, extend along the entire two lateral side ends of the outer side flap, and end at the second ends to the rear side end of the outer side flap, so as to entirely separate the two lateral side ends of the outer side flap from the respective end flaps.

* * * * *